US007381089B2

(12) United States Patent
Hosler, Sr.

(10) Patent No.: US 7,381,089 B2
(45) Date of Patent: Jun. 3, 2008

(54) COAXIAL CABLE-CONNECTOR TERMINATION

(75) Inventor: Robert Craig Hosler, Sr., Marysville, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 157 days.

(21) Appl. No.: 11/180,452

(22) Filed: Jul. 13, 2005

(65) Prior Publication Data

US 2006/0046565 A1 Mar. 2, 2006

(30) Foreign Application Priority Data

Aug. 31, 2004 (GB) ..... 0419303.3

(51) Int. Cl.
*H01R 9/05* (2006.01)

(52) U.S. Cl. ..... 439/578

(58) Field of Classification Search ..... 439/578–585, 439/98–99, 374, 378, 675
See application file for complete search history.

(56) References Cited

U.S. PATENT DOCUMENTS

| | | | | |
|---|---|---|---|---|
| 5,002,503 | A * | 3/1991 | Campbell et al. | 439/578 |
| 5,342,218 | A * | 8/1994 | McMills et al. | 439/578 |
| 6,848,940 | B2 * | 2/2005 | Montena | 439/584 |
| 2005/0159043 | A1 * | 7/2005 | Harwath et al. | 439/578 |

* cited by examiner

*Primary Examiner*—Edwin A. León
(74) *Attorney, Agent, or Firm*—Peter Van Winkle

(57) ABSTRACT

A high frequency coaxial cable having a foil (7*a*) between the cable insulator (5) and cable braid (7*b*), is terminated to a coaxial connector (40) in a manner that allows fast and easy cable preparation and results in a termination with minimal axial electric field lines that cause a high insertion loss and a high VSWR (voltage standing wave ratio). A bore (46) at the rear portion of the connector outer conductor, receives the cable insulator with foil around the cable insulator. The bore has a front part (54) that forms an interference fit around the foil, to avoid an axially-extending gap which might contain axially-extending field lines. The front of cable insulator and foil are flush and both abut the insulation (25) of the connector.

5 Claims, 6 Drawing Sheets

COAXIAL CABLE-CONNECTOR TERMINATION

CROSS-REFERENCE

Applicant claims priority from British patent application 0419303.3 filed 31 Aug. 2004.

BACKGROUND OF THE INVENTION

This invention relates to a coaxial connector for terminating to a high performance coaxial cable of the type that has a wrapped conductive shield. A coaxial cable includes a solid or stranded inner cable conductor surrounded by a layer of polymer dielectric material. The dielectric material is precisely centered within a woven braid outer cable conductor, and the cable has an outer jacket of polymer material. The outer cable conductor defines a ground return path which is necessary for microwave signal transmission.

High performance, low loss coaxial cables have been developed to transmit higher frequencies with minimal impedance discontinuities. With low loss dielectrics, these cables may transmit higher power levels with minimal attenuation. The high performance cables generally comprise an inner cable conductor surrounded by a low loss dielectric material such as cellular polyethylene, a thin wrapped metallic outer shield such as a conductive foil, a woven plated copper braid shield, and a polymer outer jacket such as polyvinyl chloride (PVC). This type of cable is desirable for use in the transmission of high rate digital signals such as those used in the High Definition Television (HDTV) industry, of a frequency of about 1 GHz and higher. FIG. 1 shows such a high performance coaxial cable 1 which comprises a center cable conductor 3 and an outer cable conductor 7 formed by a thin wrapped metallic foil 7*a* and a woven braid outer conductor 7*b*. A dielectric material, or insulator 5 separates the center conductor 3 and the outer conductor 7. The entire cable 1 is enclosed in an outer jacket 9.

Cables are generally prepared for termination to a coaxial connector by stripping, or removing, from around the center cable conductor, the dielectric material, the braid and the cable jacket to strip lengths specified by the manufacture of the RF coaxial connector. In the case of the high performance coaxial cable having a wrapped metallic foil shield, the foil is generally removed and stripped back approximately evenly with the jacket, as shown in FIG. 2*a*. The removal of the metallic foil in this way is an inconvenience for cable assembly manufacturers and cable installers because it requires the foil to be stripped back behind (within) the braid that surrounds it. This operation is time consuming and requires special tools, and may lead to damage of the braid.

A preferred termination technique would be to leave the metallic foil intact, i.e. flush with the dielectric material and/or braid. However, this presents a problem in terms of electrical performance. At lower frequencies, cables prepared and terminated in this way exhibit no electrical performance problems, with particular respect to return loss. However, at higher frequencies, a convoluted signal path occurs, and a higher than expected return loss or VSWR (voltage standing wave ratio) is exhibited.

SUMMARY OF THE INVENTION

According to the invention, there is provided a radio frequency coaxial connector for terminating a coaxial cable of the type that includes a center cable conductor, a dielectric cable insulation surrounding the center conductor, and a cable outer conductor that includes a conductive foil surrounding the dielectric material. The connector includes a tubular metallic connector having a rear end for receiving the coaxial cable and having a front end for interfacing with a complimentary connector, and a tubular insulator located within the connector outer conductor. The rear end of the connector outer conductor forms an open bore for receiving the cable center conductor, cable dielectric material and the conductive foil. A part of the bore is of a reduced diameter to provide an interference fit between walls of the connector bore and the cable conductive foil. The reduced inner diameter of the bore is preferably located adjacent to the connector insulator.

In use, the cable center conductor, the cable insulator surrounding the center conductor and the cable conductive foil, are received into the bore in the rear end of the coaxial connector. The conductive braid is placed around the rear end portion of the connector outer connector. The cable portion with foil on the outside is easily received into a rear part of the bore in the connector outer conductor, but the reduced diameter of a front bore part provides an interference fit between the conductive foil of the cable and the inner surface of walls of the bore in the connector outer conductor. This interference fit eliminates any clearance space between the conductive foil of the cable and the inner surface of the bore, and thereby eliminates a longitudinal electric field between the conductive foil and the connector body.

It has been found that prevention of such a longitudinal electric field is an effective way of maintaining the radial orientation of the electric field, thereby ensuring good electrical performance at higher frequencies.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
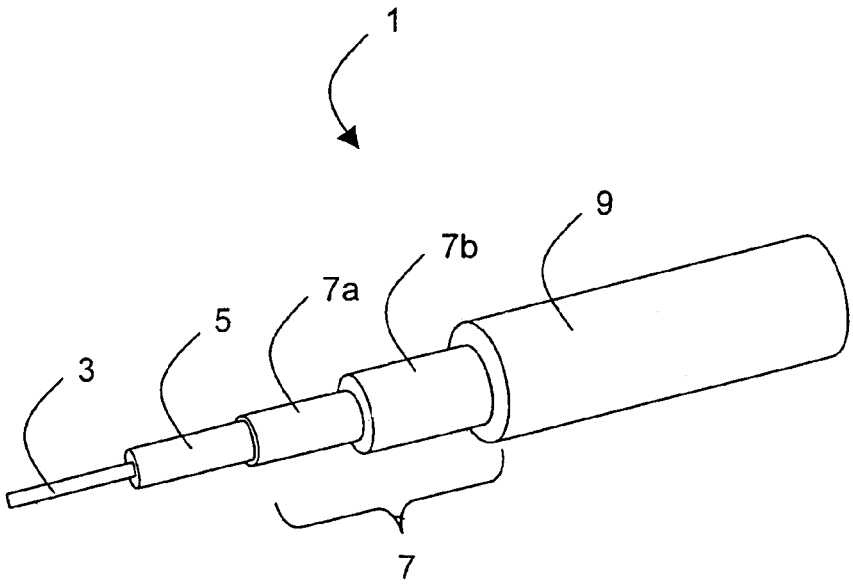
Fig. 1 PRIOR ART
FIG. 1 is a partially cut away view of a prior art high performance coaxial cable.

FIG. 1 shows a prior art high performance (low losses at frequencies of about 1 GHz and somewhat higher) coaxial cable 1. The cable includes coaxial inner and outer cable conductors 3, 7, a dielectric layer or insulator 5 between the conductors, and a protective outer jacket 9. The cable outer conductor 7 includes a conductive foil 7*a* lying around and against the insulator 5 and a conductive braid 7*b* lying around the foil.

Figure 2A:
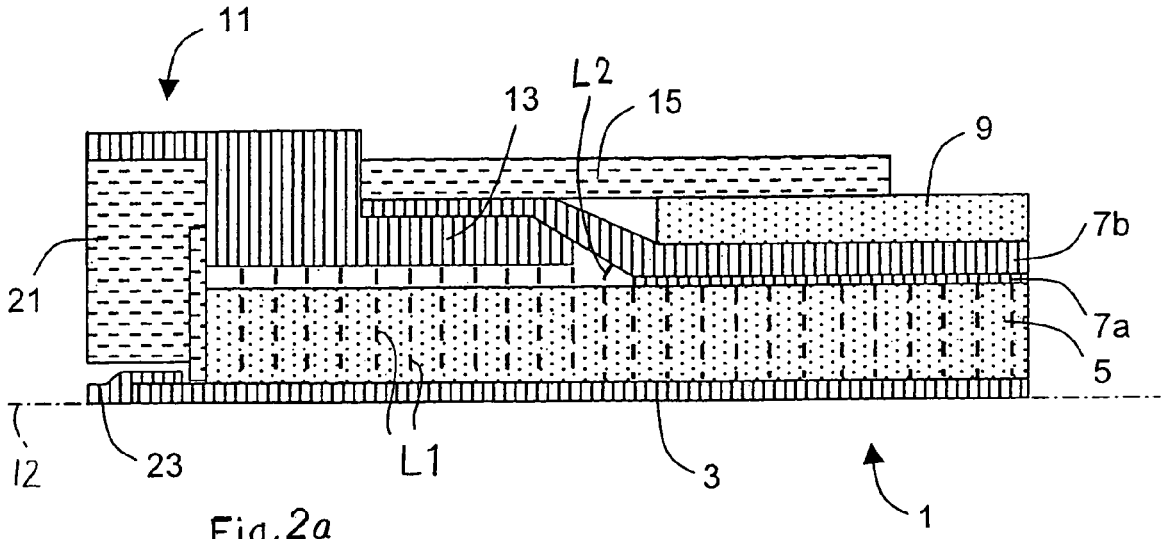
Fig. 2a PRIOR ART
FIGS. 2*a* and 2*b* are cross sectional view on one side of the axis, of the prior art high performance coaxial cable shown in FIG. 1, and shown terminated with a prior art coaxial connector.

FIG. 2*a* shows the coaxial cable 1 of FIG. 1 terminated to a prior art coaxial connector 11. Only the right portion of the connector 11 that receives the cable 1 is shown in the Figure, and only portions on one side of the coincident cable and connector axis 12 is shown. The cable jacket 9, has been stripped back (cut away) from around the cable center conductor 3 and the insulator 5. The conductive foil 7*a* also has been stripped back to a location within the cable braid 7*b* to be approximately flush with the cable jacket 9. The center conductor 3 and the cable insulator 5 are received within a rear end portion 13 of the connector outer conductor 11. The exposed cable center conductor 3 is received in a connector center conductor contact pin 23, and a front end of the cable insulator 5 abuts a corresponding connector insulator element 21 in the connector 11. The braid 7*b* of the cable outer conductor is received around the outer surface of the rear end portion 13 of the connector. A ferrule, or crimp tube 15 is crimped onto an outer surface of the connector outer conductor rear end 13, and around the cable jacket 9. The crimp tube urges the braid 7*b* against the connector outer conductor rear end portion 13 and prevents the connector 11 from detaching from the cable 1.

FIG. 2*a* shows electric field lines L1 extending between the cable center conductor 3 and the cable outer conductor 7. It can be seen from the figure that the electric field lines L1 in the intact cable insulator are radial to the axis 12. The electric field lines are slightly distorted at L2 in the region adjacent to the open rear end of the connector outer conductor portion 13, where the braid is not parallel to the center conductor. However, the slight distortion of the electric field lines L2 in this region does not cause significant reflection of energy and consequent loss. Within the rear end portion 13 of the connector outer contact, the radial orientation of the electric field lines is restored, with the field lines running from the center conductor 3 to the rear end portion 13 of the connector outer conductor (which is electrically connected to the braid 7*b*).

Figure 3:
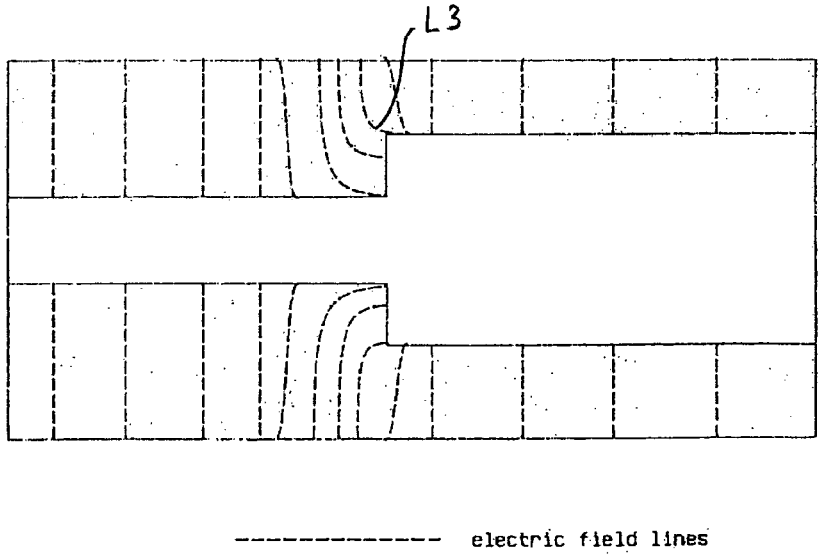
FIG. 3 is a cross sectional view showing the distortion of the electric field lines within a transmission line which is caused by a change in the conductor geometry.

Electric field lines of a high performance coaxial cable in the normal transverse electromagnetic mode of transmission are purely radial, and thus terminate perpendicular to the surfaces of the center and outer conductors. However, at sudden transitions in the diameter of the conductors, such as a step change in the conductor diameter of a coaxial connector, the electric field lines distort as at L3 in FIG. 3, so as to maintain their perpendicular relationship with the conductor surfaces. This distortion in the electric field lines creates higher order modes of propagation. Since the connector is not usually designed to transmit these higher order modes of propagation, they are attenuated over a very short distance, and are thus localized in the vicinity of the discontinuity. The high modes of the propagation lead to a power loss from the normal transverse electromagnetic mode, which results in a higher than expected return loss, or VSWR (voltage standing wave ratio), at high frequencies. The distortions upon analysis appear capacitive, and are a major source of reflections within an otherwise matched impedance connector.

It is almost impossible to avoid discontinuities in a connector design. For example, methods of terminating a cable to a connector often result in diameter variations between the cable and the connector. These variations require changes in conductor diameters to maintain the proper impedances, thus creating discontinuities. Below about 1000 MHz (1 GHZ), these discontinuities usually have no significant effect on the resulting return loss or VSWR. However, at higher frequencies, the discontinuities have a major impact on the performance of the connector.

The terminated cable shown in FIG. 2*a* provides acceptable performance in terms of return loss, even at high frequency applications such as high definition video cabling. However, as described above, the arrangement shown in FIG. 2*a* requires that the end of the cable 1 be prepared by cutting the conductive foil 7*a* away from underneath the braid 7*b*, so that the end of the conductive foil 7*a* is approximately flush with the end of the cable jacket 9.

Figure 2B:
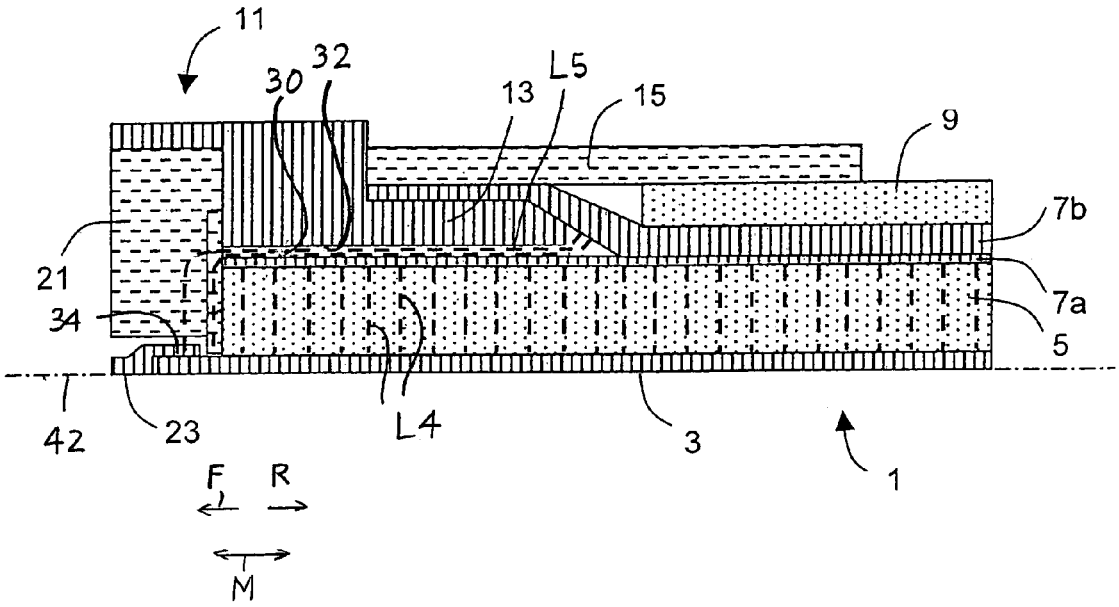
PRIOR ART Fig. 2b

FIG. 2*b* shows the prior art high performance coaxial cable 1 of FIG. 1 terminated with the same prior art coaxial connector 11 shown in FIG. 2*a*. However, in this case, only the cable jacket 9 is stripped away from around or within the braid 7*b*. The front end of the conductive foil 7*a* lies flush with the front end of the insulator 5. This is the preferred way of preparing the cable, as it does not require any special effort or special tools. Again, for clarity, only the rear part of the connector 11 that receives the cable 1 is shown in the Figure.

As shown in FIG. 2*b*, the cable center conductor 3, insulator 5 and conductive foil 7*a* are received within the rear end portion 13 of the connector. The cable center conductor 3 is received into the connector center conductor contact pin 23 and the extreme front ends of the cable insulator 5 and the conductive foil 7*a* abut the insulator element 21 in the connector 11. The conductive braid 7*b* is received around the outer surface of the outer contact end portion 13 of the connector and the crimp tube 15 is crimped onto the braid around the outer surface of the rear end 13 of the outer conductor of the connector 11.

FIG. 2*b* shows the electric field lines L4 between the center conductor 3 and the outer conductive foil 7*a* of the known high performance coaxial cable 1 shown in FIG. 1 when the cable is stripped in the easy way. It can be seen that electric field lines L4 in the cable 1 are radial to the center conductor 3 and to the conductive foil 7*a*. It can also be seen that a gap region 30 exists between the outside surface of the conductive foil 7*a* and the inside surface 32 of the bore in the outer coaxial conductor rear portion 13. Within the outer conductor rear portion 13, electric field lines L5 from the exposed end 34 of the cable center conductor 3 do not terminate at the conductive foil 3*a*. Instead, these field lines at L5 extend in a longitudinal M or axial direction (parallel to the axis 50) from the front ends of the insulator Sand conductive foil 7*a* and terminate at some point within the gap 30. These longitudinal field lines are concentrated in the gap 30 formed between the conductive foil 7*a* and the inner surface 32 of the rear end portion 13 of the connector outer conductor. The gap is a result of clearance left to allow easy cable insertion. The electric field lines are considerably distorted, resulting in a so-called cylindrical reentrant cavity which causes the connector to resonate at a specific frequency.

Figure 4:
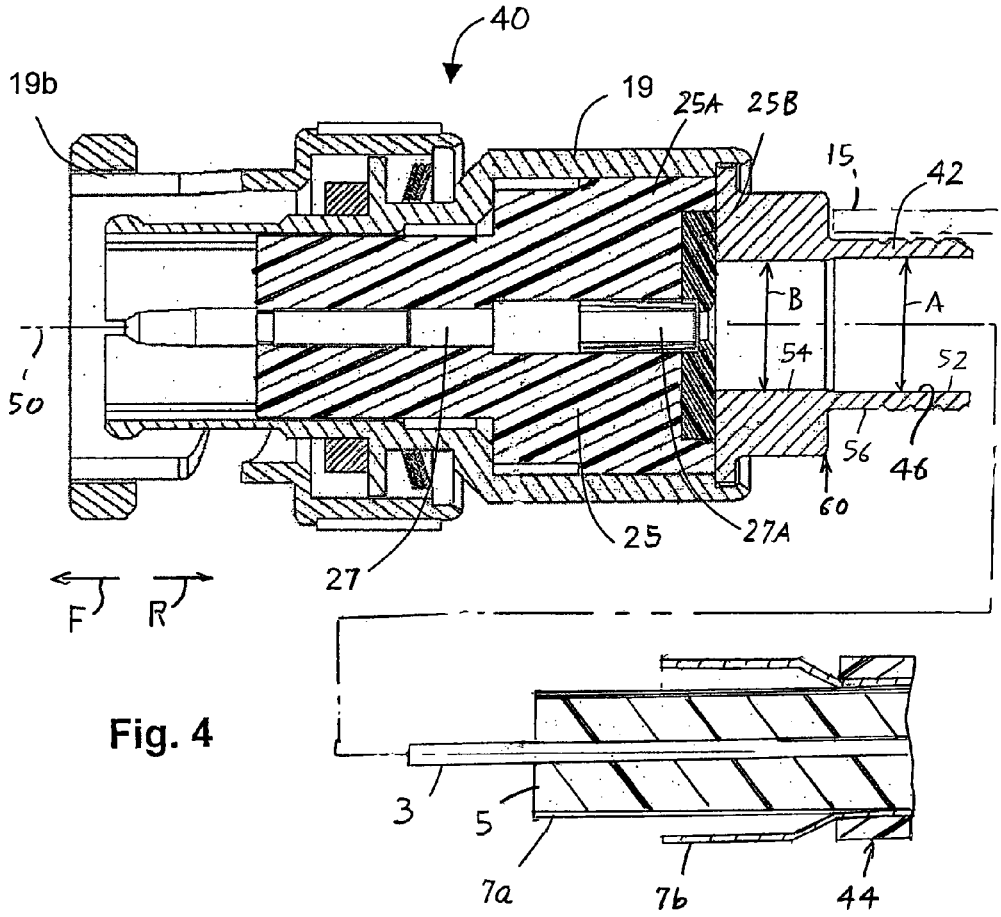
FIG. 4 is a cross sectional view of a coaxial connector according to the invention.

FIG. 4 shows a connector 40 of the invention for easily terminating a high performance coaxial cable having an outer conductive foil 7*a*, which does not cause a cylindrical reentrant cavity and the consequential high return loss, even at high frequencies. These advantages are achieved without the need for the end of the cable to be specially prepared (as shown in FIG. 2). The coaxial connector comprises a substantially tubular metallic connector outer conductor 19, a substantially tubular insulator 25, a connector center conductor contact pin 27 and a crimp tube 15.

A rear end portion 42 of the outer connector conductor 19 has a rearwardly R opening bore 46 for receiving the coaxial cable 44. The rear end portion 42 of the outer connector conductor may be a different part than the rest of the outer conductor 19, different sized rear portions 42 being provided for different sized cables 44. An interface 19*b* is of the prior art design and provides a BNC plug for interfacing with a complimentary jack. The connector insulator 25 is located between the ends of the body 19 so as to be coaxial therewith. The insulator 25 comprises two insulator blocks 25A, 25B through which are formed holes on the connector axis 50, the insulator 25B being of harder material to guide the cable center conductor. The center, or inner conductor pin 27 is located in an axial hole of the insulator 25. The pin comprises a pin portion 27A for receiving, via the bore 46, an end of the center conductor 3 of the coaxial cable. The connector 40 may also comprise a number of other components (not shown) such as a bayonet collar, gaskets, spring washers and split washers. These components are all known from existing connectors and will not be described further.

The bore 46 in the rear end 42 of the connector outer conductor leads to the insulator 25. The inner diameter of the bore steps from a first diameter A at the open rear part 52 to a second, smaller diameter B in the bore front part 54 which lies adjacent to the insulator 25. The outer surface of the rear portion 42 of the outer conductor preferably has a knurled surface.

In use, the high performance coaxial cable 44 is prepared in the same way as the cable shown in FIG. 2*b*, by stripping back the dielectric material 5 and the conductive foil 7*a* to be flush with each other (and usually with the braid 7*b*, which shortens as it is expanded). This leaves an exposed portion of center conductor 3. The prepared cable 44 is then received into the connector 40.

Figure 5:
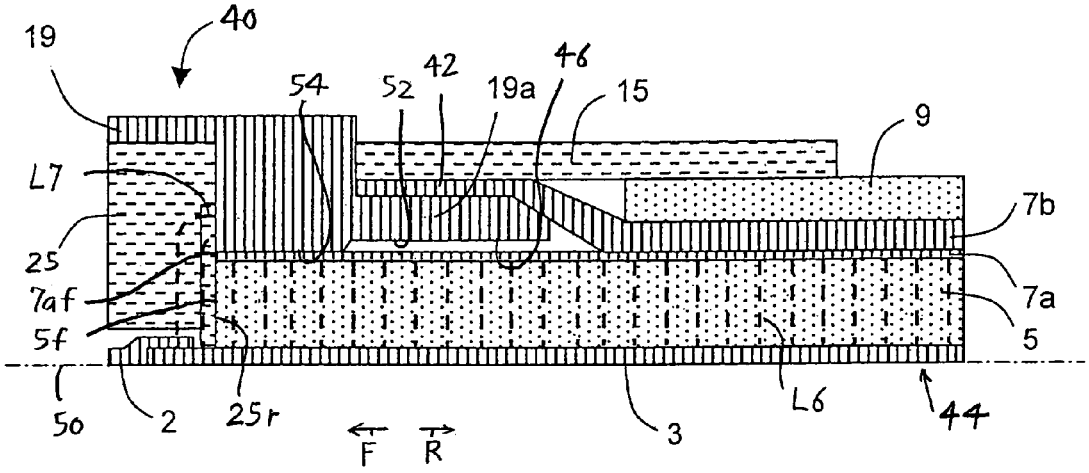
FIG. 5 is a cross sectional view on one side of the axis, of the high performance coaxial cable shown in FIG. 1 terminated with the coaxial connector shown in FIG. 4.

FIG. 5 represents the prepared cable 44 of FIG. 4 fully installed in the connector 40. It can be seen that the cable center conductor 3, the cable insulator 5 and the cable conductive foil 7*a* are received within the bore 46 in the rear end of the connector outer conductor. The exposed portion of the cable center conductor 3 is received into the connector center conductor 2. The extreme front ends 5*f* and 7*af* of the insulator 5 and conductive foil 7*a* then abut a rear end 25*r* of the insulator 25 of the connector 40. The relative dimensions of the bore and the cable components are such that the cable insulator 5 and conductive foil 7*a* are easily received into the bore rear part 52, but that the smaller bore front part 54 creates an interference fit with the conductive foil 7*a*.

In the specific example shown in FIG. 5, the outer diameter of the conductive foil 5 is 3.78 mm and the rear and front part inner diameters A, B of the bore are 3.9 mm and 3.68 mm respectively. Thus, there is a slight interference of about 0.1 mm between the foil and the front bore diameter. The cable insulator 5 compresses to allow the foil to fit into the front bore part. To further the connection of cable to the connector, the braid 7*b* is expanded to lie around the outer surface of the rear end portion 19*a* of the outer conductor and the crimp tube 15 is crimped around the braid.

FIG. 5 shows the electric field lines L6, L7 between the cable center and outer conductors 3, 7 and the connector outer conductor 19. The electric field lines L6 in the intact cable 44 are radial. Within the bore, the electric field lines are radial, terminating at the center conductor 3 and the conductive foil 7*a*. However, in contrast to the arrangement shown in FIG. 2*b*, there are only insignificant longitudinal electric field lines L7 extending parallel to the axis 50. This is because the interference fit between the conductive foil 5 and the inner surface of the bore front part 54 ensures that there are no clearance gaps and eliminates paths for electric field distortion. Instead, almost all of the electric field lines from the center conductor terminate directly to the connector body.

Figure 6A:
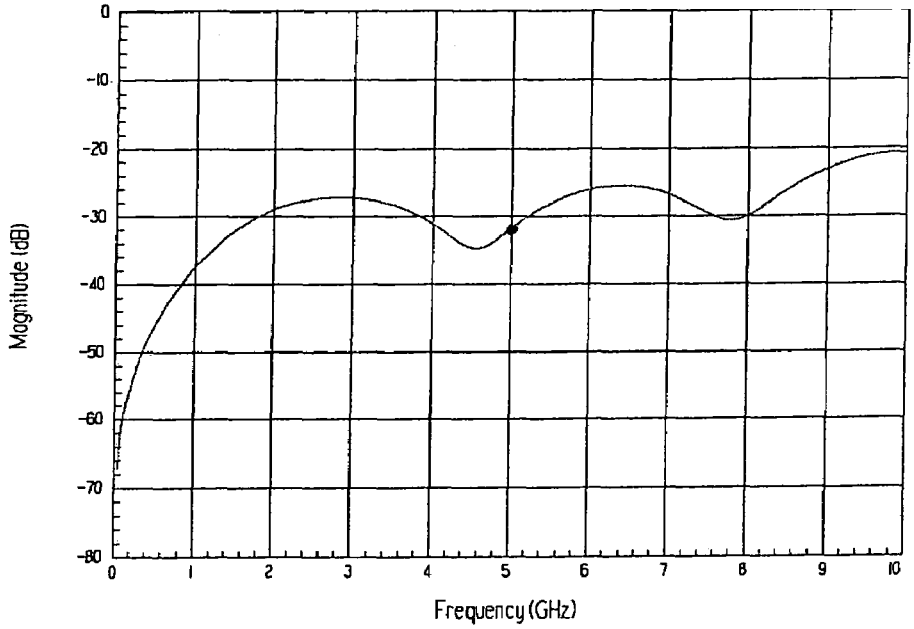
FIGS. 6*a*, 6*b* and 6*c* show predicted return loss for the terminated coaxial connectors shown in FIGS. 2*a*, 2*b* and 5 respectively.
Figure 6B:
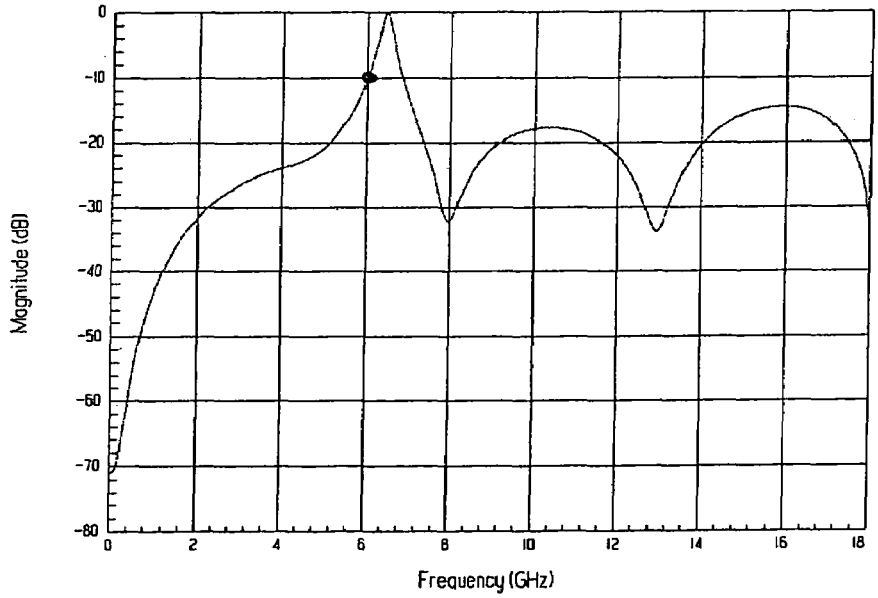
Figure 6C:
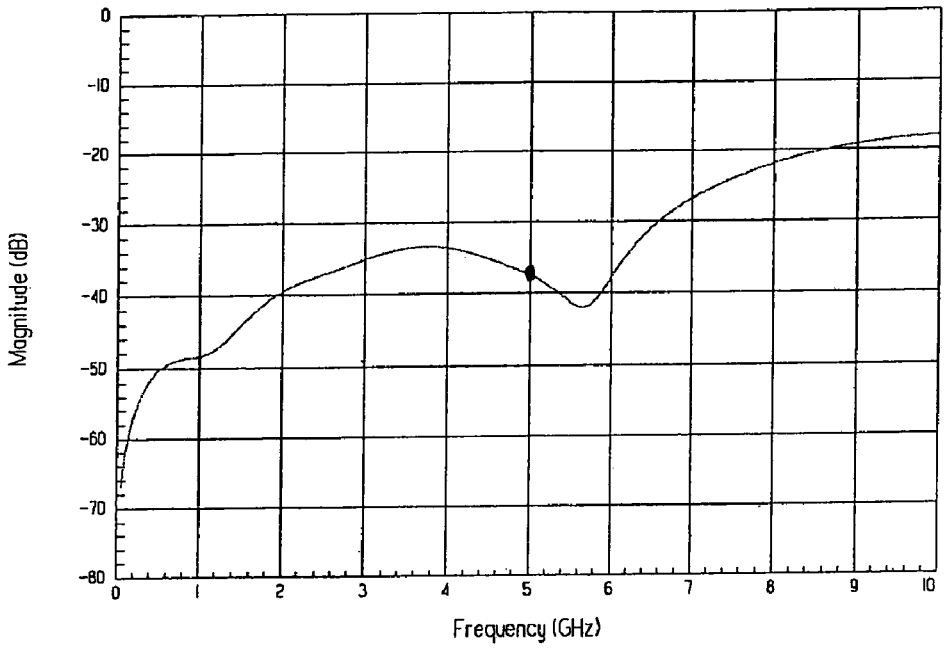

As noted above, the elimination of the axial electric field lines reduces return loss and VSWR at high frequencies. FIGS. 6*a*, 6*b* and 6*c* are graphs showing predicted return loss for the terminated coaxial connectors shown in FIGS. 2*a*, 2*b* and 5 respectively. The graphs are directly comparable. It can be seen from the graph that the return loss for the coaxial connector of the invention (FIG. 6*c*) is an improvement on that shown in FIG. 6*b*, and is similar to that shown in FIG. 6*a*. For example, at a frequency of 5 GHz, the terminated coaxial connector arrangement of the invention results in a predicted return loss (FIG. 6*c*) of −38 dB, while for the prior connector arrangement of FIG. 2*b*, the predicted return loss (FIG. 6*b*) is −10 dB. For a large gap 32 (FIG. 2*b*) there may be a resonance near the desired operating frequency resulting in dropoff of the signal.

Figure 7A:
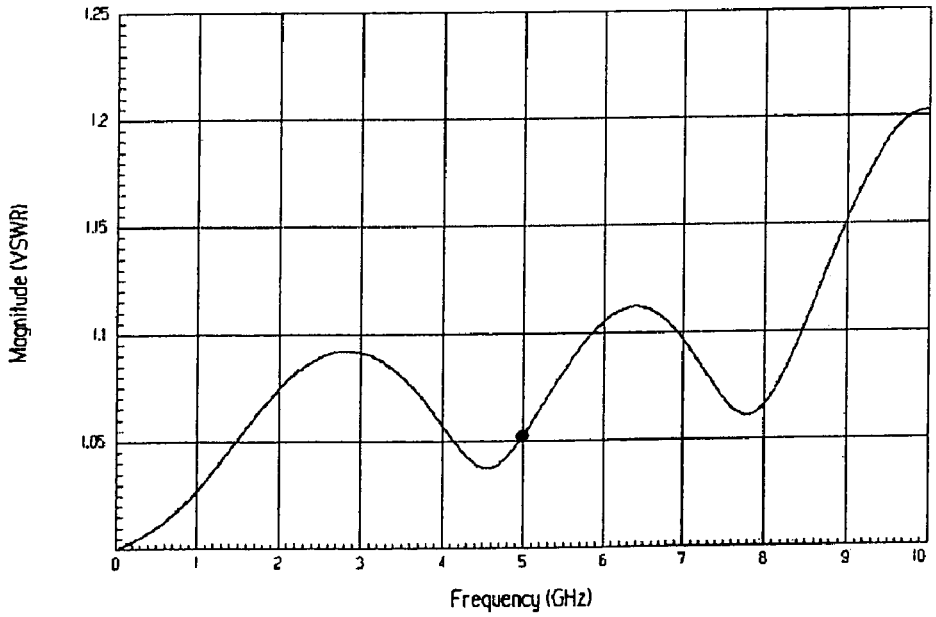
FIGS. 7*a*, 7*b* and 7*c* show predicted voltage standing wave ratios (VSWR) for the coaxial connectors shown in FIGS. 2*a*, 2*b* and 5 respectively.
Figure 7B:
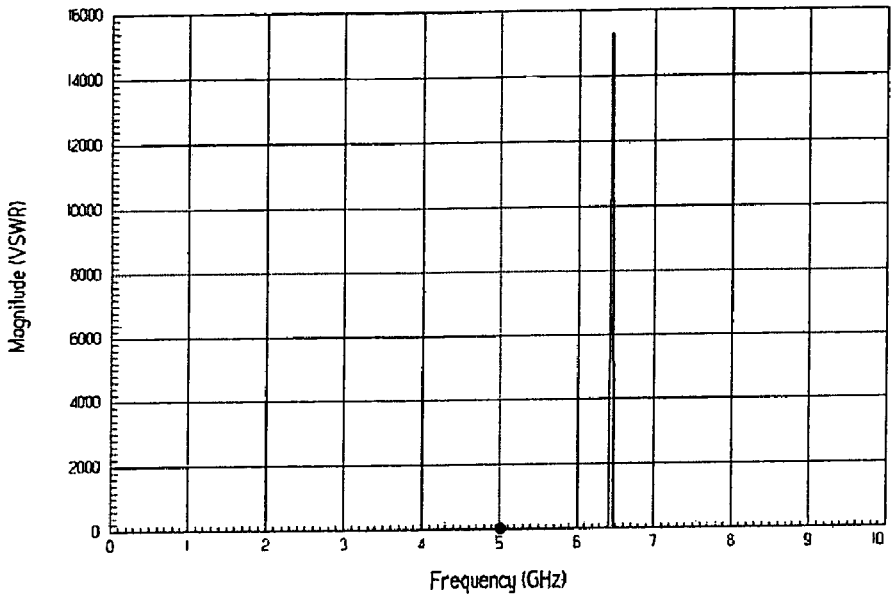
Figure 7C:
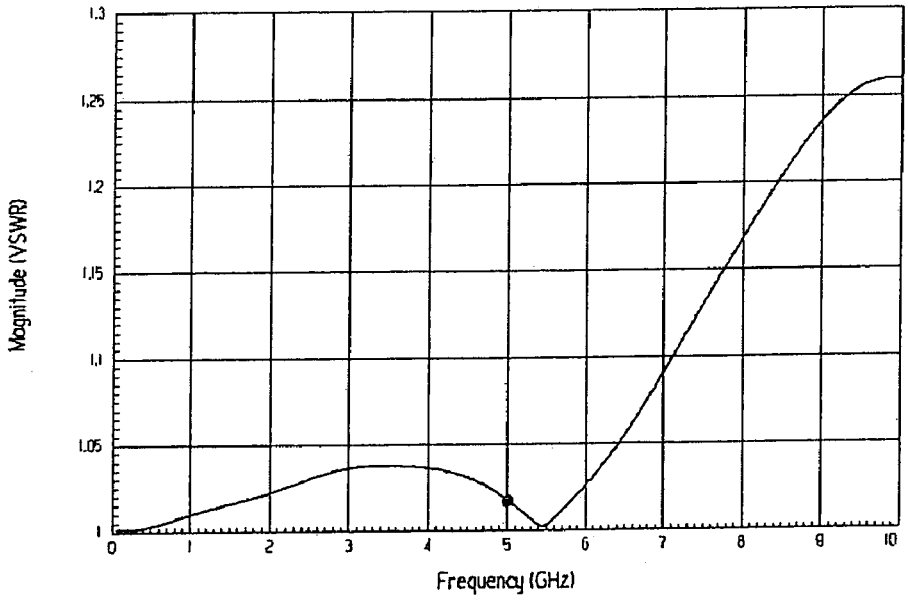

FIGS. 7*a*, 7*b* and 7*c* are directly comparable graphs showing predicted voltage standing wave ratio (VSWR) for the coaxial connectors shown in FIGS. 2*a*, 2*b* and 5 respectively. Again, it can be seen from the graphs that the VSWR for the coaxial connector of the invention (FIG. 7*c*) is a considerable improvement on that shown in FIG. 7*b*, in that there is no specific resonant frequency. The VSWR for the coaxial connector of the invention is similar to that shown in FIG. 7*a*.

In the connector described above, the bore of the rear end of the connector body has two inner diameters with a step between them. However, other bore profiles are suitable. For example, the inner diameter of the bore may gradually ramp from the first diameter to the second diameter, or more than two discrete inner diameters may be provided. What is important is that an interference fit is provided between the bore and the conductive foil of the cable adjacent the insulator arrangement of the connector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus which includes a high frequency coaxial connector that has inner and outer connector conductors and a connector insulator between them that are centered on an axis and which includes a coaxial cable that has inner and outer cable conductors and a cable insulator between them, said cable inner and outer conductors having front end portions connected to rear end portions of said connector inner and outer conductors, respectively, wherein the cable outer conductor includes a conductive foil that lies against an outside of said cable insulator, wherein:

said inner connector conductor has a bore and said cable conductor foil has an outside surface with a foil cylindrical front end and with said cable insulator lying immediately within said cylindrical front end without a gap between them;

said bore in said connector outer conductor has a front end with an inner cylindrical surface, has a slightly smaller inside surface diameter than said foil cylindrical front end so the foil front end must be forced forwardly into the bore, with said cable insulator being compressed as a result of said foil cylindrical front end lying in an interference fit with walls of said bore inner cylindrical surface, to thereby prevent the distortion of electric field lines between said foil and said connector outer conductor.

2. The apparatus described in claim 1 wherein said cable outer conductor includes a conductive braid that is expandable in diameter and that surrounds and is in contact with said foil, and wherein:

said braid is initially cut even with said foil, and said braid has a front end part that is expanded in diameter, said connector outer conductor having a rear end part of greater inside diameter than said foil-engaging part, and said expanded braid front end part lies around and is connected to a rear end portion of said connector outer conductor.

3. The apparatus described in claim 1 wherein:

said connector insulator has a rear end, and said conductive foil and said cable insulator have extreme front ends that abut said connector insulator rear end.

4. Apparatus that includes a high frequency coaxial connector that has inner and outer connector conductors and a connector insulator between, and that includes a coaxial cable that has inner and outer cable conductors centered on an axis and a cable insulator between them, said cable inner and outer conductors having front end portions connected to rear end portions of said connector inner and outer conductors, respectively, wherein the cable outer conductor includes a conductive foil that lies around said cable insulator, wherein:

said connector outer contact rear portion has a cylindrical inside surface part that lies around and against said foil, said foil and said cable insulator have extreme front ends which are flush with each other, said connector insulator has a rear end portion lying at a rear end of said cylindrical inside surface of said connector outer contact rear portion, and said extreme front end of said cable insulator abuts said connector insulator rear end.

5. Apparatus that includes a high frequency coaxial connector that has inner and outer connector conductors and a connector insulator between, and that includes a coaxial cable that has inner and outer cable conductors centered on an axis and a cable insulator between them, said cable inner and outer conductors having front end portions connected to rear end portions of said connector inner and outer conductors, respectively, wherein the cable outer conductor includes a conductive foil that lies around said cable insulator, wherein:

said connector outer contact rear portion has a cylindrical inside surface part that lies around and against said foil and that radially inwardly presses the foil against a portion of said cable insulator that lies radially inside and against said foil and that radially compresses said portion of the insulator;

said foil and said cable insulator have extreme front ends which are flush with each other, said connector insulator has a rear end portion lying at a rear end of said cylindrical inside surface of said connector outer contact rear portion, and said extreme front end of said cable insulator abuts said connector insulator rear end.

* * * * *